US008066201B2

(12) United States Patent
So

(10) Patent No.: US 8,066,201 B2
(45) Date of Patent: Nov. 29, 2011

(54) METHOD AND APPARATUS FOR SUPPLYING A FLUID

(76) Inventor: Kim Lui So, Singapore (SG)

( * ) Notice: Subject to any disclaimer, the term of this patent is extended or adjusted under 35 U.S.C. 154(b) by 478 days.

(21) Appl. No.: 12/280,515

(22) PCT Filed: Jan. 24, 2007

(86) PCT No.: PCT/SG2007/000021

§ 371 (c)(1),
(2), (4) Date: Dec. 15, 2008

(87) PCT Pub. No.: WO2007/097714

PCT Pub. Date: Aug. 30, 2007

(65) Prior Publication Data

US 2010/0001098 A1 Jan. 7, 2010

(30) Foreign Application Priority Data

Feb. 24, 2006 (SG) ..... 200601235-5

(51) Int. Cl.
*B05B 17/00* (2006.01)

(52) U.S. Cl. ..... 239/1; 239/104; 239/106; 239/120; 239/548; 239/566; 239/597; 239/601; 29/890.142; 29/890.143

(58) Field of Classification Search ..... 239/103, 239/104, 106, 107, 120–122, 548, 565–568, 239/597, 598, 601, 1; 29/890.142, 890.143
See application file for complete search history.

(56) References Cited

U.S. PATENT DOCUMENTS

| | | | | |
|---|---|---|---|---|
| 2,665,946 | A | 1/1954 | Broughton | |
| 3,447,756 | A * | 6/1969 | Lawrence, Jr. | 239/568 |
| 3,584,786 | A * | 6/1971 | Johnson | 239/568 |
| 3,647,147 | A * | 3/1972 | Cook | 239/601 |
| 4,161,873 | A * | 7/1979 | Mabery | 29/890.142 |
| 4,435,891 | A * | 3/1984 | Nicholson | 239/597 |
| 6,065,321 | A | 5/2000 | Kosch et al. | |

FOREIGN PATENT DOCUMENTS

| | | | |
|---|---|---|---|
| CA | 2424989 | A1 | 5/2002 |
| EP | 169764 | A | 1/1986 |
| GB | 2093372 | A | 9/1982 |
| SU | 889117 | A | 12/1981 |

* cited by examiner

*Primary Examiner* — Steven J Ganey
(74) *Attorney, Agent, or Firm* — Browning Bushman P.C.

(57) ABSTRACT

Apparatus for supplying a fluid comprising a pipe having at least one aperture through a wall of the pipe, each of the at least one apertures comprising a first portion in an inner surface of the wall, a second portion in an outer surface of the wall, the first portion intersecting the second portion to form an opening, the first portion having a first cross-sectional area at the inner surface that is greater than a second cross-sectional area of the opening; wherein the first cross-sectional area and the second cross-sectional area have a first ratio within a first predetermined range so as to enable fluid flowing through the pipe at a predetermined flow rate to exert a predetermined pressure to spray fluid from the at least one aperture to atmosphere and also to flush the first portion.

19 Claims, 9 Drawing Sheets

METHOD AND APPARATUS FOR SUPPLYING A FLUID

TECHNICAL FIELD

This invention relates to a method and apparatus for supplying a fluid, a method of manufacturing the apparatus and a method for cleaning the apparatus and refers particularly, though not exclusively to a pipe system that is more easily manufactured and requires reduced maintenance.

BACKGROUND

Pipe systems used in such as, for example, fluid circulation systems, require regular maintenance to keep the systems in efficient working order. The pipe system may comprise a plurality of fluid outlets where deposits accumulate in a circumferential surface of each of the plurality of fluid outlets.

In pipe systems used in such as, for example, water supply systems or crop irrigation systems, it is important that all the deposits are removed from the fluid outlets to maintain a smooth flow in the system.

Specialized labour is required to clean the fluid outlets. Such maintenance is costly and is a substantial expense to businesses when the number of systems to be serviced is high.

Also, the manufacturing process normally requires the drilling and tapping of holes, then manual insertion of outlet nozzles. This can be time consuming, and expensive.

SUMMARY

In accordance with a first exemplary aspect, there is provided apparatus for supplying a fluid, the apparatus comprising: a pipe having at least one aperture through a wall of the pipe, each of the at least one apertures comprising a first portion in an inner surface of the wall, a second portion in an outer surface of the wall, the first portion intersecting the second portion to form an opening, the first portion having a first cross-sectional area at the inner surface that is greater than a second cross-sectional area of the opening.

The first cross-sectional area and the second cross-sectional area may have a first ratio within a first predetermined range so as to enable fluid flowing through the pipe at a predetermined flow rate to exert a predetermined pressure to spray fluid from the at least one aperture to atmosphere and also to flush the first portion.

The first portion and/or the second portion of the at least one aperture may each be of a shape selected from: circle, polygon, segment of a sphere, ellipsoid and slot. The first portion may be of a shape selected from: sphere, cylinder, cone, and ellipse. The second portion may be formed by one of a drilled hole, and a cut. Both the cut and the drilled hole may be into the wall from the outer surface but not being through the wall. The second portion may have a depth and the first portion may have a depth, the two depths being of a second ratio within a second predetermined range to determine a spray shape and a spray angle.

The first portion may be formed by one of drilling or cutting into the wall from the inner surface. The portion may not be through the wall. The first portion may comprise a cylindrical portion extending from the inner surface, and a curved portion.

The second portion may be formed by cutting into the wall from the outer surface using a cutting disc, the cutting disc having a thickness, the depth of the cut into the wall determining the length of the opening, and the thickness of the disc determining the width of the opening. The maximum length of the opening may be determined by the cylindrical portion diameter. There may be a plurality of intersecting cuts. The cuts may be identical.

According to another exemplary aspect there is provided a fluid circulation system comprising a plurality of valves; a pump; and apparatus as described above. The pipe may be mounted within a fluid tray having at least one opening aligned with and larger than the at least one aperture to enable fluid to be sprayed from the apertures through the openings. There may be a clearance pipe connected to the pump for enabling fluid in the tray to be drawn through the at least one aperture into the pipe for clearing the at least one aperture by reverse flush.

According to a final exemplary aspect there is provided a method for forming an apparatus for supplying a fluid, the method comprising: forming a first portion of at least one aperture into a wall of a pipe at a desired location, the first portion being formed from an inner surface of the wall; forming a second portion of the at least one aperture into the wall but not through the wall from an outer surface of the wall at the desired location, the second portion being formed of a depth to intersect the first portion to create an opening.

The first portion may be formed by: drilling a hole through the wall of the pipe; drilling into an inner surface of the wall at the desired location diagonally opposite the hole to form the first portion of the at least one aperture; and plugging the hole with a fluid-tight plug.

The first portion may be into but not through the wall. The first portion may be formed by cutting into the wall at the desired location from the inner surface of the wall, the cutting being from within the pipe. The at least one aperture may be of a shape consisting of: circle, polygon, segment of a sphere, or slot. The first portion may be of a shape selected from at least one of the group consisting of: sphere, cylinder, cone, ellipsoid and ellipse. The first portion may have a first cross-sectional area at the inner surface that is greater than a second cross-sectional area being the cross-sectional area of the opening.

The first cross-sectional area and the second cross-sectional area may have a first ratio within a first predetermined range so as to enable fluid flowing through the pipe at a predetermined flow rate to exert a predetermined pressure to spray fluid from the at least one aperture to atmosphere and also to flush the first portion.

The second portion may have a depth and the first portion may have a depth, the two depths being of a second ratio within a second predetermined range to determine a spray shape and a spray angle.

The first portion may comprise a cylindrical portion extending from the inner surface, and a curved portion.

The second portion may be formed by cutting into the wall from the outer surface using a cutting disc, the cutting disc having a thickness, the depth of the cut into the wall determining the length of the opening, and the thickness of the disc determining the width of the opening. The maximum length of the opening may be determined by the cylindrical portion diameter. A plurality of intersecting cuts is formed from the outer surface. Each of the plurality of cuts may be identical.

BRIEF DESCRIPTION OF THE DRAWINGS

In order that the present invention may be fully understood and readily put into practical effect, there shall now be described by way of non-limitative example only exemplary embodiments, the description being with reference to the accompanying illustrative drawings.

In the drawings.

DETAILED DESCRIPTION OF THE EXEMPLARY EMBODIMENTS

Figure 1:
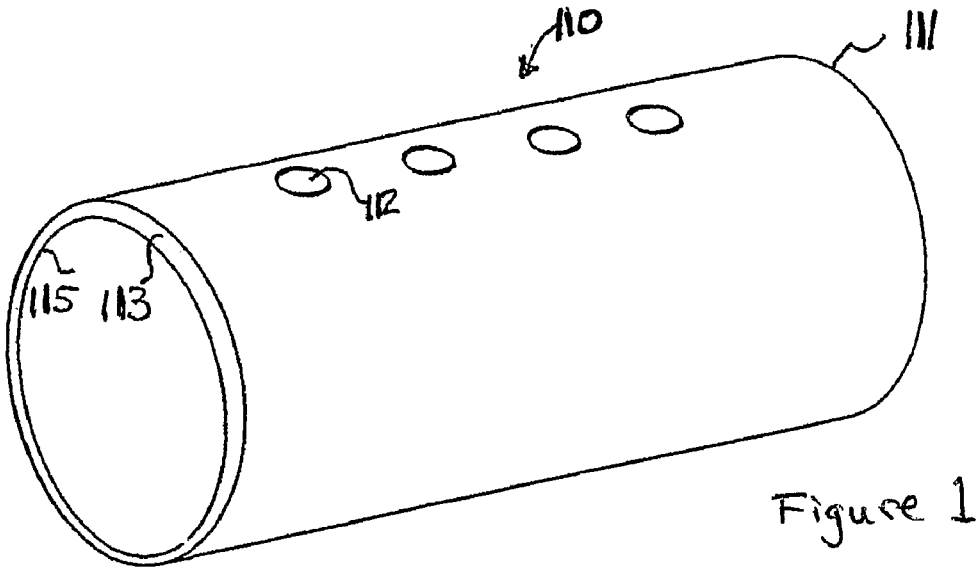
FIG. 1 is a perspective view of an apparatus according to an exemplary embodiment.

Throughout the description like reference numerals are used for like components but with a prefix number indicating the relevant embodiment.

Figure 2:
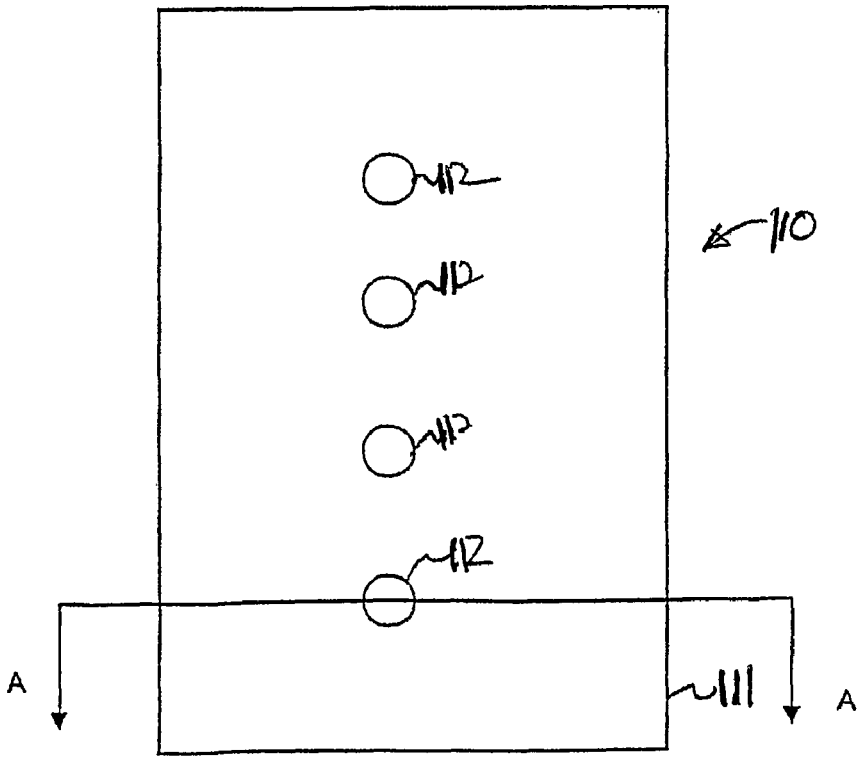
FIG. 2 is a top view of the apparatus of FIG. 1.
Figure 3:
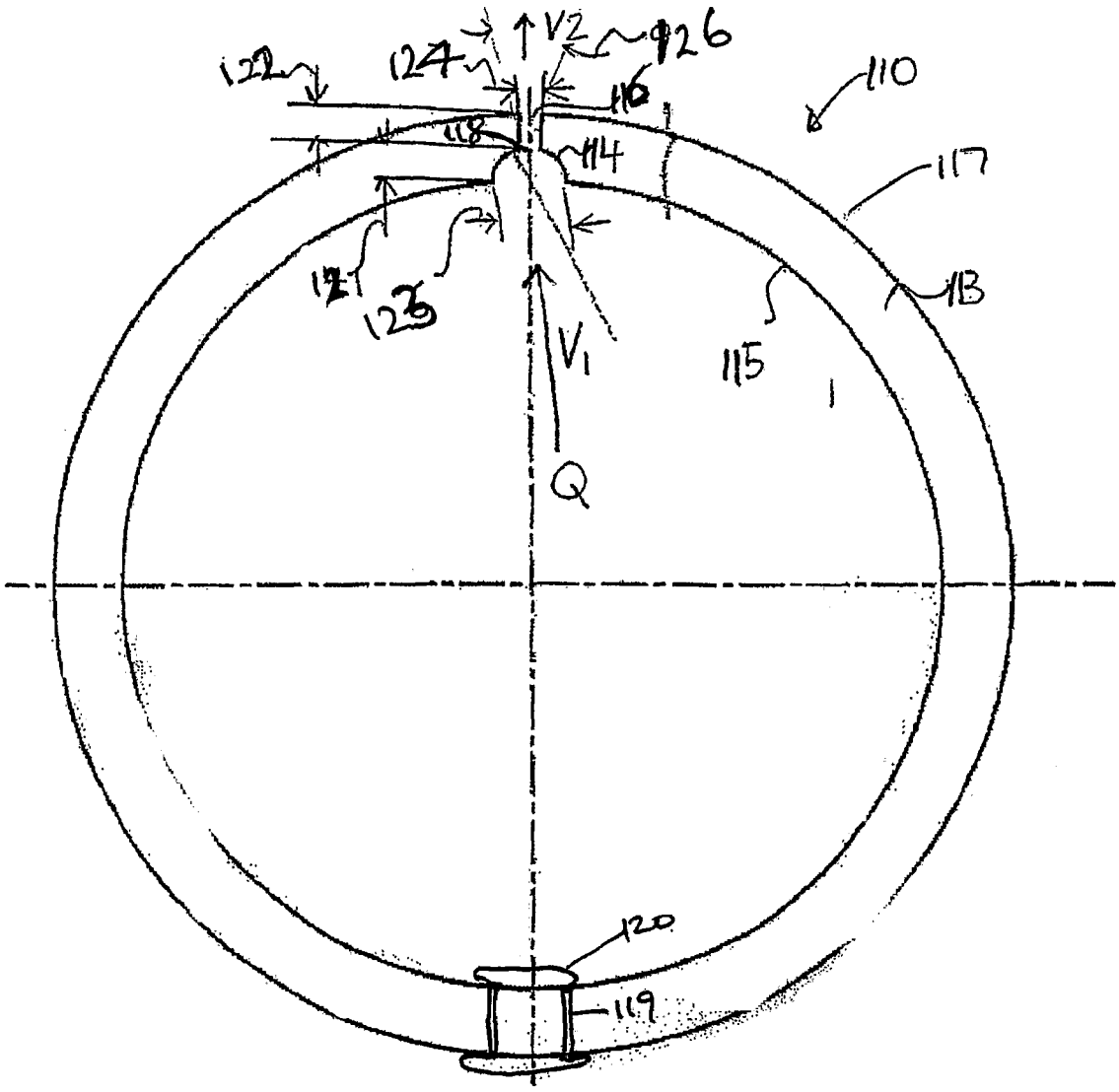
FIG. 3 is a vertical cross section view along the lines and in the direction of arrows A-A on FIG. 2.
Figure 4:
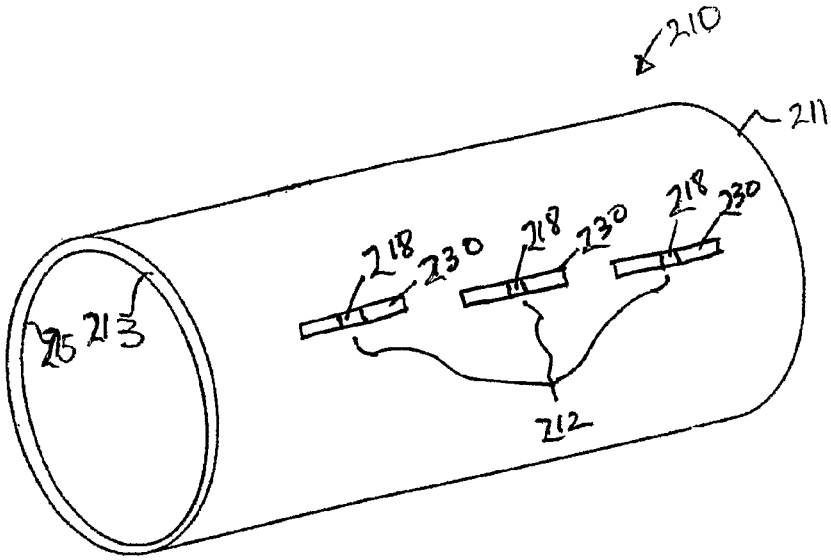
FIG. 4 is a perspective view of an apparatus according to another exemplary embodiment.
Figure 5:
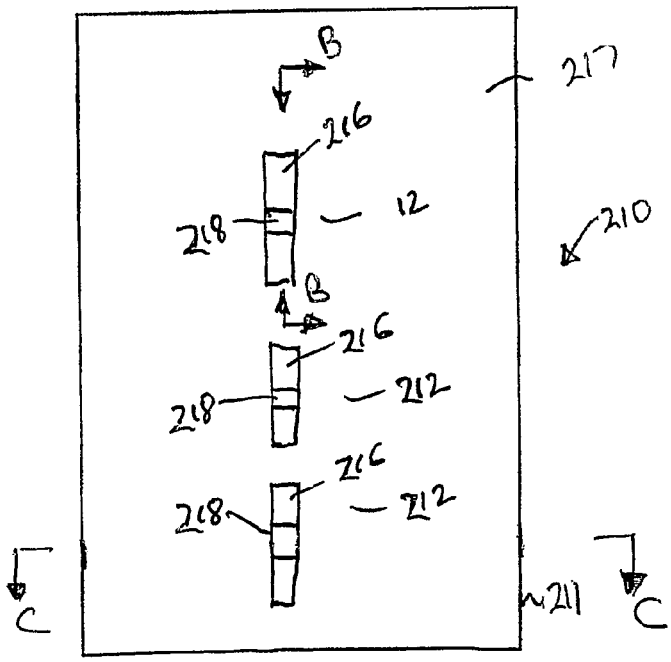
FIG. 5 is a top view of the apparatus of FIG. 4.
Figure 6:
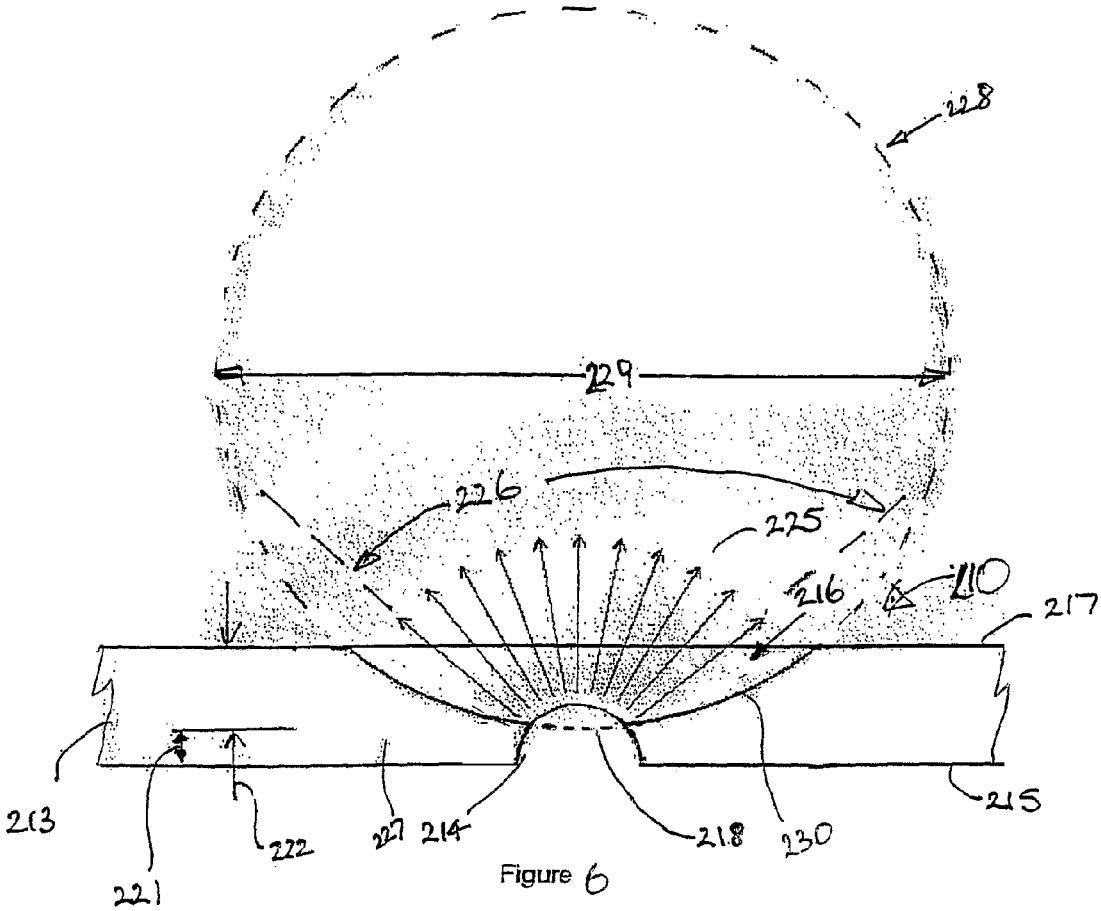
FIG. 6 is a vertical cross sectional view along the lines and in the direction of arrows B-B on FIG. 5.
Figure 7:
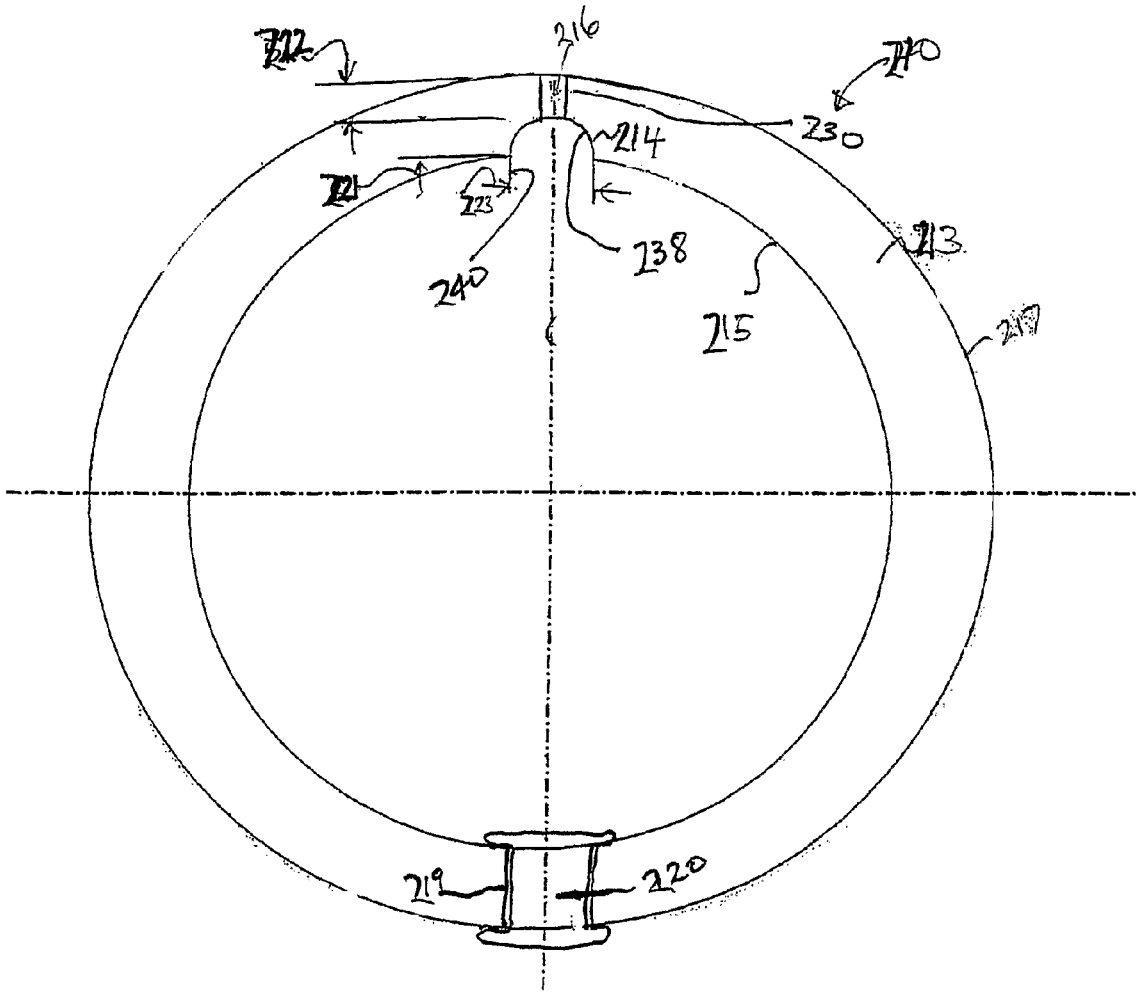
FIG. 7 is a full vertical cross sectional view along the lines and in the direction of arrows C-C on FIG. 5.
Figure 8:
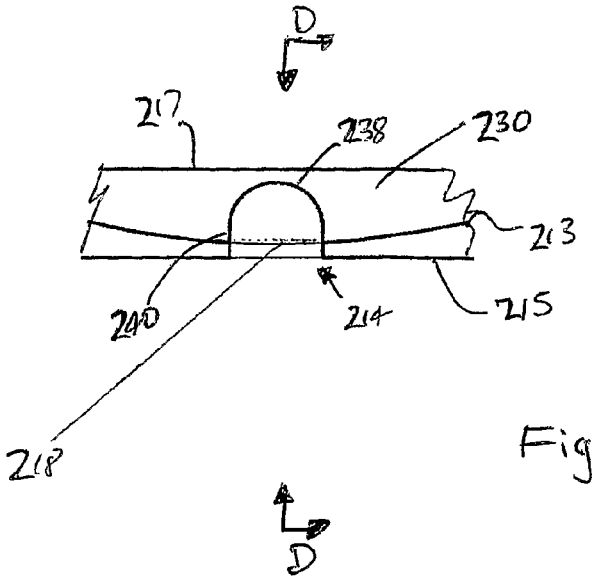
FIG. 8 is a view of the aperture portion of FIGS. 4 to 6.
Figure 9:
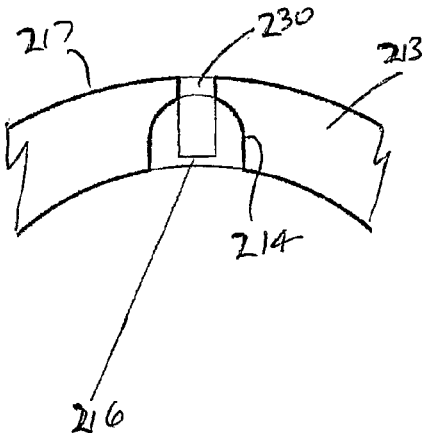
FIG. 9 is a full vertical cross-sectional view along the lines of and in the direction of arrows D-D on FIG. 8.

FIGS. 1 to 3 show an apparatus 110 for supplying a fluid in an enclosure according to an exemplary embodiment. The fluid may be, for example, a fluid that is in normal circumstances considered as being an incompressible fluid. The apparatus 110 comprises a pipe 111 having a plurality of apertures 112 through a wall 113 of the pipe 111. Each of the plurality of apertures 112 has a first portion extending from an inner surface 115 of the wall 113, and a second portion 116 extending from the outer surface 117 of the wall 113, the first portion 114 and the second portion 116 intersecting to form an opening 118.

The pipe 111 may be of a shape selected from a group consisting of: polygon, ellipse and circle. Each of the plurality apertures 112 may be equidistantly spaced to provide an even distribution of fluid.

The first portion 114 is formed by drilling through the wall 113 diagonally opposite the position where the first portion 114 is required, and then into the wall 113 to form the first portion 114. This forms a hole 119 ultimately closed by a fluid-tight plug 120.

The first portion 114 is of a radial depth 121 from the inner surface 115 of wall 113 to the opening 118 that is preferably less than the thickness of the wall 113. As such, the first portion 114 preferably extends into but not through the wall 113. However, if the drill bit just penetrates the outer surface 117 of the wall 113 such that the opening in the outer surface formed thereby is less than the size (width or diameter) of the second portion 116, the aperture 112 is still able to be correctly formed and to operate successfully.

Similarly, the second portion 116 is formed in the outer surface 117 and into the wall 113 to intersect with the first portion 114, the second portion 116 being of a depth 122 from the outer surface 117 to the opening 118 that is less than the thickness of the wall 113. As such, the second portion 116 extends into but not through the wall 113.

The sum of the depths 121, 122 is the same as the thickness of wall 113.

As the first portion 114 is drilled it is concave relative to the inner surface 115. It will have a first cross sectional area 123 at the inner surface 115 that is circular. As a drill bit is used, the opening 118 has a second cross sectional area and shape that is representative of the diameter and shape of the tip of the drill bit used to form the first portion 114. The second cross-sectional area 124 is also representative of the shape, method of forming and size of the second portion 116. The cross sectional area and shape of the opening 118 will be dependent upon the first portion 114, the second portion 116, and the depth of penetration of the second portion 116 into the first portion 114.

As shown on FIG. 3, the second portion 116 is a drilled hole of a diameter less than the diameter of the first portion 114. The first portion 114 and the second portion 116 are preferably co-axial and are radially aligned. Therefore, in this embodiment the opening 118 will be circular and thus the spray 125 will be a jet spray that is circular in transverse cross section.

Fluid flows through the pipe 111 at a predetermined flow rate Q ($m^3/s$). The fluid passes through the first cross sectional area 123 at a velocity $V_3$. As the first cross sectional area 123 is greater than the second cross sectional area 124 at the opening 118, a velocity $V_2$ at the second cross sectional area 124 is greater than the velocity $V_1$ to provide a hydraulic force to spray fluid from each aperture 112. The sprayed fluid or spray, as well as the fluid flowing along the pipe 111, flushes any contaminant or debris residing in the first portion 114. The first portion 114 may be of a shape selected from one or more of: sphere, cone, ellipse, and cylinder.

The depths 121, 122 have a ratio within a predetermined range. The size of opening 118 and the system fluid pressure as well as the pump pressure control an exit flow rate of the fluid. The exit flow rate may be predetermined depending on the type of application in which the fluid is applied.

FIGS. 4 to 9 show another exemplary embodiment (prefix number is 2) comprising an apparatus 210 for supplying a fluid. The apparatus 210 comprises a pipe 211 having a plurality of apertures 212 through a wall 213 of the pipe 211. Each of the plurality of apertures 212 has a first portion 214 in an inner surface 215 of the wall 213 extending to a second portion 216.

Each of the plurality apertures 212 may be equidistantly spaced to provide an even distribution of fluid.

To obtain the desired spray shape 225, the aperture 212 may be of a shape selected from: circle, polygon, segment of a sphere, slot ellipse, circle, and polygon. Each aperture 212 is formed by a cut 230 being the second portion 216, and a first portion 214, intersecting as before to form an opening 218.

The second portion 216 is formed as the cut 230 in the outer surface 217 of wall 213. A cutting wheel or disc 228 of a diameter 229 may be used to form the cut 230. The cut 230 intersects the first portion 214 to form the opening 218. The opening 218 will be somewhat rectangular and will thus have a spray shape 225 that is fan shaped. The spray angle 226 will depend on the depth of penetration of the cut 230 into the first portion 214. The greater the depth of penetration of the cut 230 into the first portion 214, the larger the opening 218 will be and thus the greater the spray angle 226 and spray width. Conversely, the smaller the depth of penetration of the cut 230 into the first portion 214, the smaller the opening 218 and thus the smaller the spray angle 226.

The thickness of the disc 228 will determine the thickness of the cut 230 and thus the spray thickness.

The first portion 214 may be of an increased depth 221 such that it comprises a curved portion 238 and a straight-sided or cylindrical portion 240. The cylindrical portion 240 provides the maximum size and cross-sectional area of the opening 218. As such, by controlling the thickness and depth of cut 230, the size of opening 218 is determined. The greater the depth of cut 230, the greater is the length of opening 218 and thus the greater is the spray angle 226. The thickness of the spray 225 will be determined by the thickness of the disc 228 and thus the thickness of the cut 230. The opening 218 will be of the same thickness as the cut 230, and the length of the opening will be determined by the depth of the cut 230. The maximum area of the opening is determined by the diameter of the drill bit that forms first portion 214 as if the cut 230 is of sufficient depth that is extends to the cylindrical portion 240, the diameter of the cylindrical portion 240 is the maximum length of the opening 218. If the thickness of the cut 230 is the same as or larger than the diameter of the first portion 214, and the depth of the cut 230 is that it is into the cylindrical portion 240, the shape of the opening 218 will be circular, and the diameter of the opening 218 will be the same as the cylindrical portion 240. This will give a jet spray 225.

Instead of drilling, the first portion 114, 214 may be formed by cutting using a cutting tool inserted into the pipe 111, 211.

Figure 10:
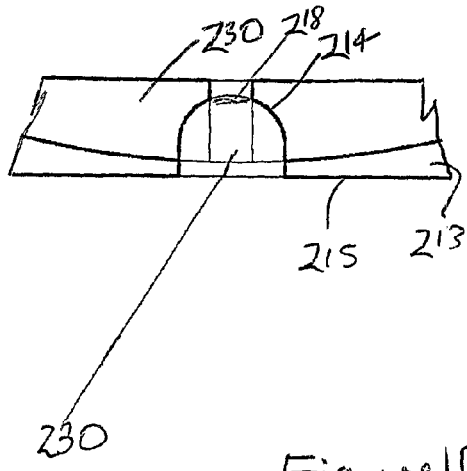
FIG. 10 is a view corresponding to FIG. 9 of a further exemplary embodiment.

As is shown in FIG. 10, multiple cuts 730 may be made at intersecting angles to form spray shapes of varying nature. For example, and as shown, two identical cuts 730 of equal depth are made perpendicular to each other. This will give a cruciform-shaped spray.

Figure 11:
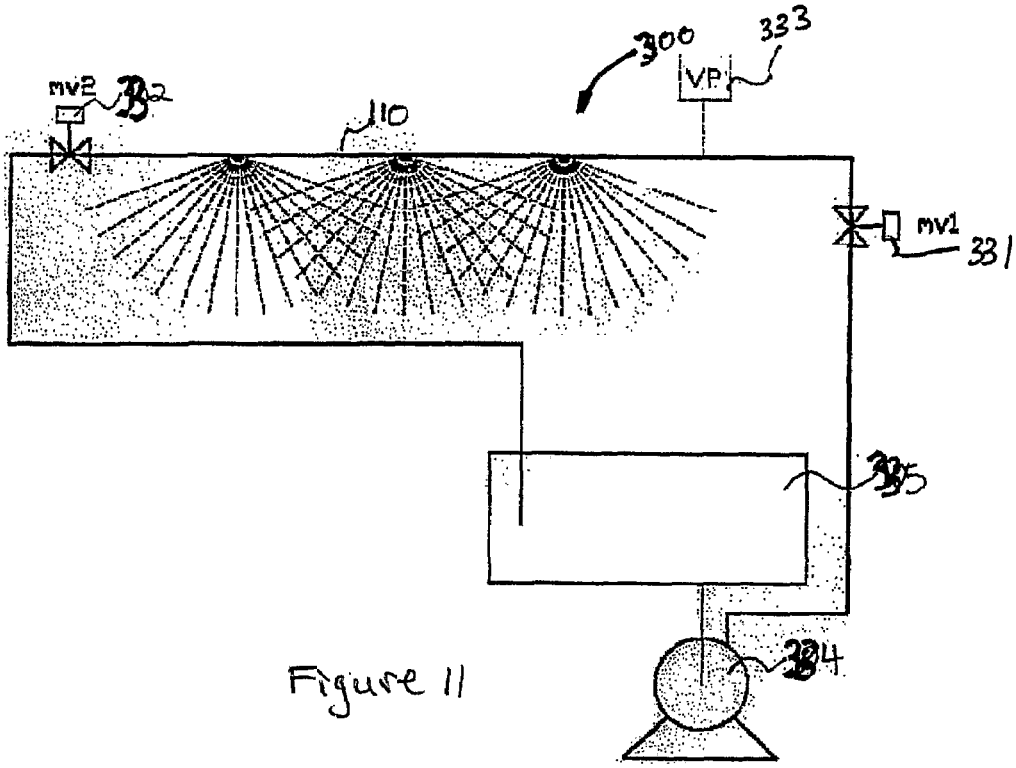
FIG. 11 is a schematic view of a fluid circulation system according to a further exemplary embodiment.

FIG. 11 is a schematic view of the apparatus 110 of the first two exemplary embodiments in use in a first fluid circulation system 300. The fluid circulation system 300 comprises the apparatus 110, a first valve 331, a second valve 332, a vacuum pump 333, a water pump 334 and a water tank 335. In a first operation mode, the first valve 331 is opened and the second valve 332 is closed. The vacuum pump 333 is switched off. Fluid is pumped from the water tank 335 at a predetermined pressure and flows through the pipe 112. When the fluid passes each first portion 114, the fluid flows through the first portion 114, the opening 118, the second portion 116, then to atmosphere.

In a second operation mode, the first valve 331 and the second valve 332 are closed. The vacuum pump 333 is switched on to create a negative pressure within the pipe 111 with respect to atmospheric pressure. As a result of the negative pressure, a suction force a generated to suck any dirt residing within the apertures 112 inside the pipe 111. The first valve 331 and the second valve 332 are opened and the vacuum pump 333 is turned off. Then the water pump 335 is turned on to let the water flow in to flush the dirt back to the water tank 335. The dirt is trapped by a filter system 336. The filter system 336 may be positioned within, or may be external of, the water tank 335.

Figure 12:
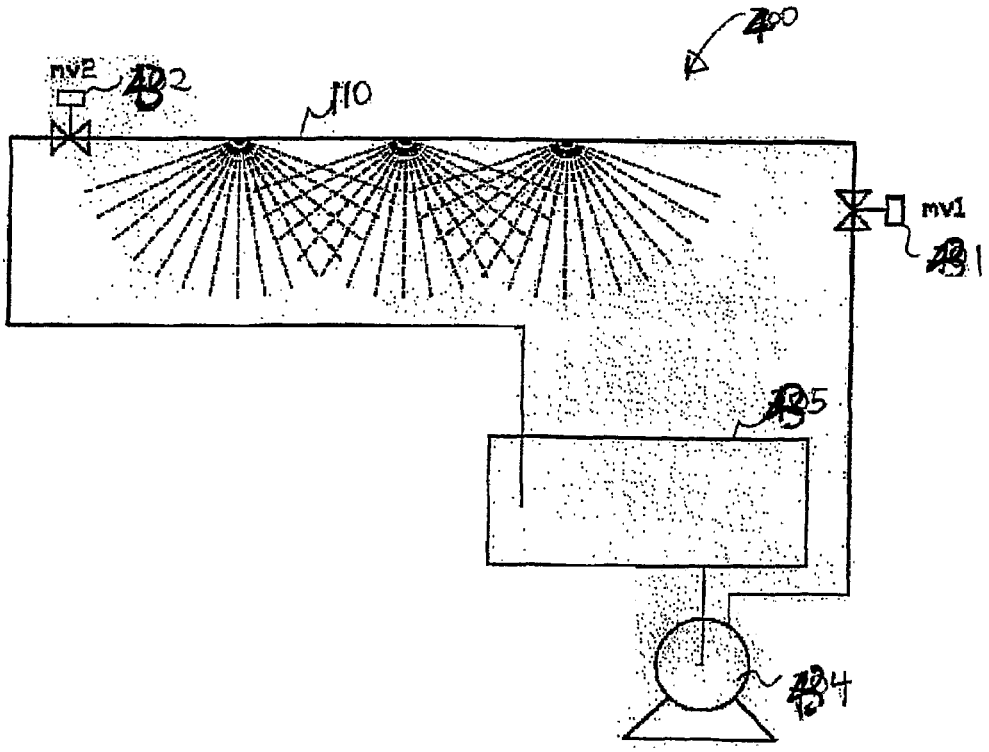
FIG. 12 is a schematic view of a fluid circulation system according to a penultimate exemplary embodiment.

FIG. 12 is a schematic view of the apparatus of the first two exemplary embodiments in use in a second fluid circulation system 400. The fluid circulation system 400 comprises the apparatus 110, a first valve 431, a second valve 432, a water pump 434 and a water tank 435. In a first operation mode, the first valve 431 is opened and the second valve 432 is closed. Fluid is pumped from the water tank 435 at a predetermined pressure and flows through the pipe 112. When the fluid passes each first portion 114, the fluid flows through the first portion 114, opening 118 and the second portion 116 to atmosphere to flush the first portion 114.

In a second operation mode, the first valve 431 and the second valve 432 are turned on. The water pump 434 is turned on to flush the dirt back to the water tank 435. The dirt is trapped by a filter system 436. The filter system 436 may be positioned within, or may be external of, the water tank 435.

Figure 13:
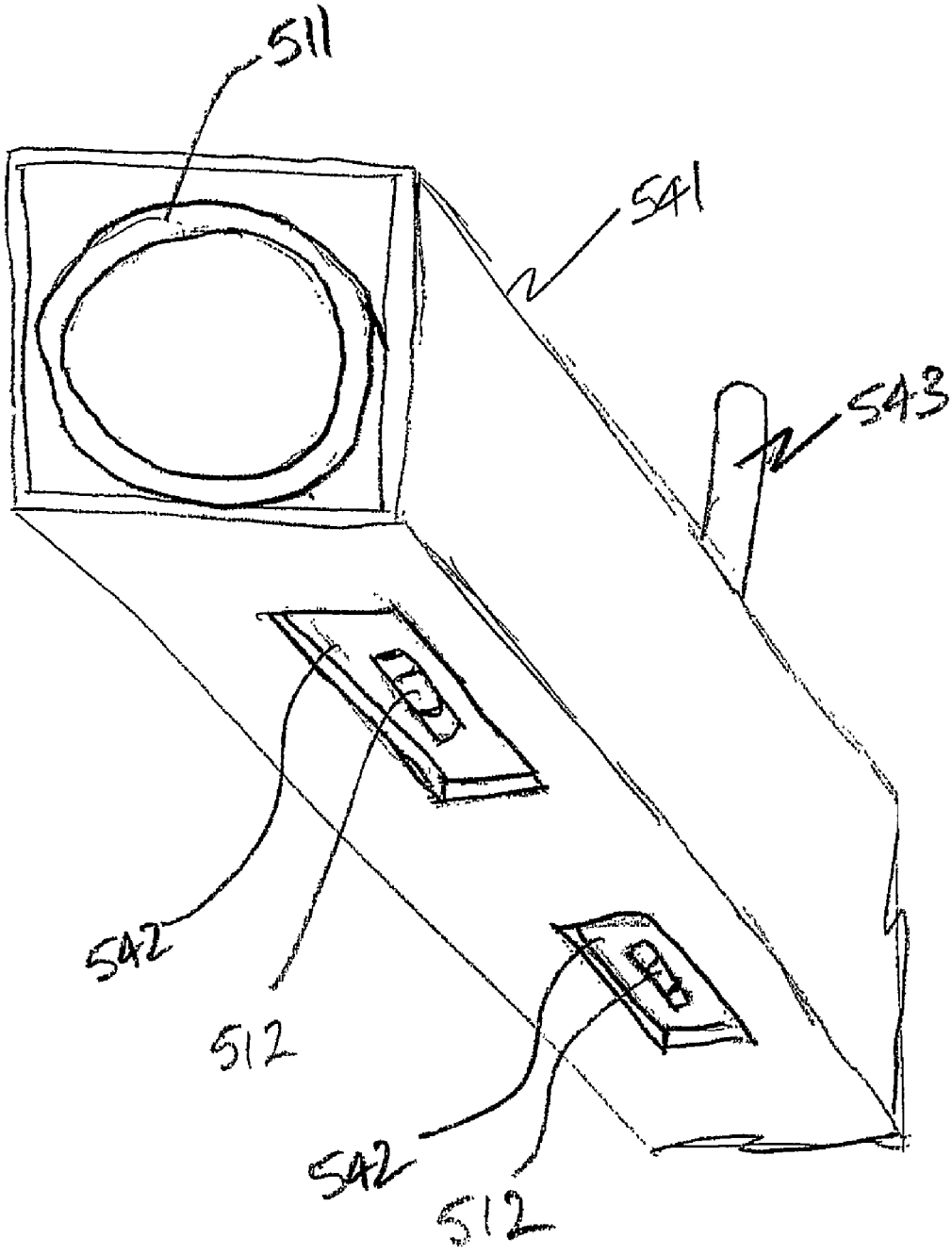
FIG. 13 is a perspective view of an apparatus according to a final exemplary embodiment.
Figure 14:
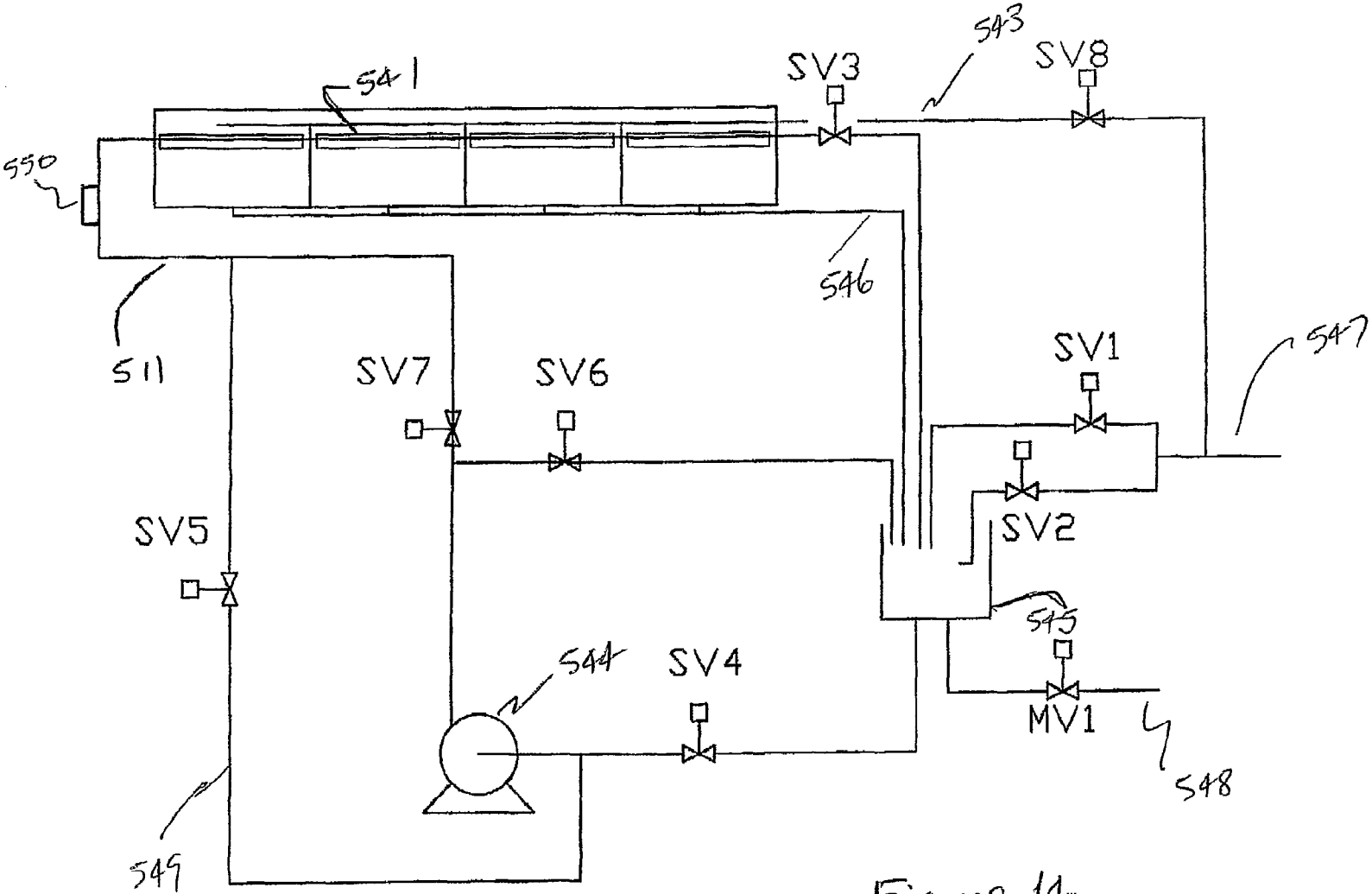
FIG. 14 is a schematic view of a fluid circulation system according to a final exemplary embodiment.

FIGS. 13 and 14 illustrate a final exemplary embodiment. Here there is a pipe 511 having a plurality of apertures 512 formed as described above. The pipe 511 is enclosed in a fluid tray 541 that has a plurality of openings 542 that are aligned with and larger than the apertures 512 so that the fluid can spay outwardly from the pipe 511 and the tray 541. A fluid inlet pipe 543 provides a source of fluid for the tray 541. If any of the apertures 512 become blocked due to contaminants, by supplying fluid through pipe 543 into tray 541, and having the pump 544 in a suction mode, fluid is drawn through the apertures 512 to clear any blockage provided the rate of fluid supplied through pipe 543 is greater than any fluid loss though openings 542.

During normal operation, valves MV1, SV1, SV2, SV3, SV5, SV6 and SV8 are all closed. Valves SV4 and SV7 are open. Pump 544 is operating. Fluid is drawn from the circulation tank 545 by the pump 544 and supplied by pipe 511. The return pipe 546 collects the fluid and returns it to the circulation tank 545. If the fluid level in tank 545 becomes low, valve SV1 is opened to add fluid to tank 545 from fluid supply 547. At the end of normal operation, pump 544 is switched off, and valve MV1 is opened to drain all unwanted contaminants from tank 545 to grease trap 548. Valve SV2 is opened to supply fluid from fluid supply 547 to the tank 545 to flush the filter (not shown) inside the tank 545. Valves MV1 and SV2 are then closed. Valve SV1 is then opened to supply fluid from fluid supply 547 to the tank 545 to fill tank 545 to the required level. Valve SV3 is then opened and pump 544 operated to clear pipes 511 and 546 by flushing. The pump 544 is then switched off and valve SV3 closed.

If any aperture 512 is blocked (completely or partially), valves SV4 and SV7 are closed and valves SV5, SV6 and SV8 are opened. By valve SV8 being opened, fluid from supply 547 is supplied to supply pipe 543 to fill the trays 541. The pump 544 is switched on. Fluid that passes through openings 542 is collected by return pipe 546 and passed to tank 545. As clearance pipe 549 is connected on the suction side of pump 544, valves SV8, SV5 and SV6 are open, and valves SV1, SV3, SV4 and SV7 are closed, the pump 544 will suck the fluid in the trays 541 into pipe 511 through the apertures 512 to clear the apertures 512 by the reverse flush. As the first portion 214 is normally larger than the second portion 216, any blockage will most likely be in the second portion 216 and will thus be easily drawn into the first portion 214 and thus into pipe 511, from where it can be eliminated. By having the trays 541, any blockage in an aperture 512 is, in effect, softened by soaking in the fluid in the tray 541. If the fluid contains a degreaser, detergent or soap, or is warm or hot, it will enhance this softening effect as well as the clearing by reverse flushing. A pressure sensor 550 may be placed in pipe 511 and having an appropriate output. A high pressure in pipe 511 would indicate there may be a blockage in one or more of the apertures 512.

The embodiment of FIGS. 13 and 14 is also able to be used with conventional spray outlets.

Whilst there has been described in the foregoing description preferred embodiments of the present invention, it will be understood by those skilled in the technology concerned that many variations or modifications in details of design or construction may be made without departing from the present invention.

The invention claimed is:

1. Apparatus for supplying a fluid, the apparatus comprising:

a pipe having at least one aperture through a wall of the pipe, each of the at least one aperture comprising a first portion in an inner surface of the wall, the first portion including a cylindrical portion extending from the inner surface; a second portion in an outer surface of the wall, the first portion intersecting the second portion to form an opening, the second portion being formed by cutting into the wall from the outer surface using a cutting disc, the cutting disc having a thickness, the depth of the cut into the wall extending to the cylindrical portion such that the diameter of the cylindrical portion is the length of the opening, and the thickness of the disc is the width of the opening.

2. Apparatus as claimed in claim 1, wherein the first portion has a first cross-sectional area at the inner surface that is greater than a second cross-sectional area of the opening.

3. Apparatus as claimed in claim 1, wherein the first cross-sectional area and the second cross-sectional area have a first ratio within a first predetermined range so as to enable fluid flowing through the pipe at a predetermined flow rate to exert a predetermined pressure to spray fluid from the at least one aperture to atmosphere and also to flush the first portion.

4. Apparatus as claimed in claim 1, wherein the cut into the wall is of a depth less than the thickness of the wall.

5. Apparatus as claimed in claim 1, wherein the second portion is into the wall from the outer surface but not through the wall.

6. Apparatus as claimed in claim 1, wherein the second portion has a length and the first portion has a length, the two lengths being of a second ratio within a second predetermined range to determine a spray shape and a spray angle.

7. Apparatus as claimed in claim 1, wherein the first portion is formed by one of drilling or cutting into the wall from the inner surface, but not being through the wall.

8. Apparatus as claimed in claim 1, wherein there is a plurality of intersecting cuts.

9. A fluid circulation system comprising:

a plurality of valves;

a pump; and apparatus as claimed in claim 1.

10. A fluid circulation system as claimed in claim 9, wherein the pipe is mounted within a fluid tray having at least one opening aligned with and larger than the at least one aperture to enable fluid to be sprayed from the apertures through the openings.

11. A fluid circulation system as claimed in claim 10, wherein a clearance pipe is connected to a suction side of the pump for enabling fluid to be drawn through the at least one aperture into the clearance pipe for clearing the at least one aperture, and the fluid being in the tray.

12. A method for forming an apparatus for supplying a fluid, the method comprising:

forming a first portion of at least one aperture into a wall of a pipe at a desired location, the first portion being formed from an inner surface of the wall, the first portion including a cylindrical portion extending from the inner surface;

forming a second portion of the at least one aperture into the wall but not through the wall from an outer surface of the wall at the desired location, the second portion being formed of a depth to intersect the first portion to create an opening; wherein the second portion is formed by cutting into the wall from the outer surface using a cutting disc, the cutting disc having a thickness, the depth of the cut into the wall extending to the cylindrical portion such that the diameter of the cylindrical portion is the length of the opening, and the thickness of the disc is the width of the opening.

13. The method as claimed in claim 12, wherein the first portion is formed by:

drilling a hole through the wall of the pipe;

drilling into an inner surface of the wall at the desired location diagonally opposite the hole to form the first portion of the at least one aperture;

plugging the hole with a fluid-tight plug;

the first portion being into but not through the wall.

14. The method as claimed in claim 12, wherein the first portion is formed by cutting into the wall at the desired location from the inner surface of the wall, the cutting being from within the pipe.

15. The method as claimed in claim 12, wherein the at least one aperture is of a shape selected from at least one of the group consisting of a circle, a polygon, a segment of a sphere, and a slot.

16. The method as claimed in claim 12, wherein the first portion is of a shape selected from at least one of the group consisting of a sphere, a cylinder, a cone, an ellipsoid, and an ellipse.

17. The method as claimed in claim 12, wherein the first portion has a first cross-sectional area at the inner surface that is greater than a second cross-sectional area being the cross-sectional area of the opening, the first cross-sectional area and the second cross-sectional area having a first ratio within a first predetermined range so as to enable fluid flowing through the pipe at a predetermined flow rate to exert a predetermined pressure to spray fluid from the at least one aperture to atmosphere and also to flush the first portion.

18. The method as claimed in claim 12, wherein the second portion has a depth and the first portion has a depth, the two depths being of a second ratio within a second predetermined range to determine a spray shape and a spray angle.

19. The method as claimed in claim 12, wherein a plurality of intersecting cuts is formed from the outer surface, each of the plurality of cuts being identical.

* * * * *